US006473315B2

(12) United States Patent
Denmeade

(10) Patent No.: US 6,473,315 B2
(45) **Date of Patent: *Oct. 29, 2002**

(54) TELECOMMUNICATIONS EQUIPMENT TRANSPORTATION APPARATUS

(76) Inventor: Timothy J. Denmeade, 4419 Garvers Fairy Rd., Lower Burrell, PA (US) 15068

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/473,759

(22) Filed: Dec. 28, 1999

(65) Prior Publication Data

US 2002/0101726 A1 Aug. 1, 2002

(51) Int. Cl.[7] ..... H02B 1/01

(52) U.S. Cl. ..... 361/831; 361/753; 224/153; 224/275

(58) Field of Search ..... 361/752, 753, 361/826, 824, 825, 759; 206/576, 320, 305; 190/102, 106, 110, 113; 224/153, 157, 275

(56) References Cited

U.S. PATENT DOCUMENTS

| | | | | |
|---|---|---|---|---|
| 2,261,291 | A | 11/1941 | Salavsky | |
| 2,853,219 | A | 9/1958 | Schwartz | |
| 3,690,446 | A | 9/1972 | Spainhour et al. | |
| 4,383,626 | A | 5/1983 | Weinblatt | |
| 4,458,813 | A | 7/1984 | Tushinsky et al. | 206/320 |
| 4,506,769 | A | 3/1985 | Franco et al. | |
| 4,580,667 | A | 4/1986 | Herwood | |
| 4,585,196 | A | 4/1986 | Cormier | |
| 4,635,110 | A | 1/1987 | Weinblatt | |
| 4,658,298 | A | 4/1987 | Takeda et al. | 358/254 |
| 4,658,956 | A | 4/1987 | Takeda et al. | |
| 4,669,001 | A | 5/1987 | Thrush | 360/33.1 |

(List continued on next page.)

*Primary Examiner*—Kamand Cuneo
*Assistant Examiner*—Tuan Dinh
(74) *Attorney, Agent, or Firm*—Cohen & Grigsby, P.C.

(57) ABSTRACT

The telecommunications equipment transportation apparatus of the present invention is comprised of components including a base section, a container section and a harness system. The base provides a suspension which forms the supporting foundation for the unit and the equipment stored therein, and houses a power circuit that includes electrical outlet(s) for providing battery or generator-supplied alternating current (AC) or direct current (DC) power to the transported telecommunications equipment. The container is comprised of compartments that can be totally sealed for transport and storage, along with panel(s) which open to allow access to the viewing monitor and controls of transported equipment such as computers and TV sets. The container preferably provides a mounting point for the base and incorporates flexible ventilated structural panels along one or more or all surfaces and includes an internal strapping arrangement to provide an adjustable locking mechanism to secure and contain the transported equipment. The harness system is designed for multiple application use to accommodate placement of the transported equipment in different locations and configurations, and includes fasteners and straps designed to secure the system both from the interior and exterior, along with multiple attachment points to allow for adjustment of either the external harness system and/or internal harness system to accommodate differently sized and/or constructed anchoring points for the unit. An optional carrying strap is designed so the system can be transported as a hand held unit, and fasteners and straps can be arranged so that the unit can be hung from any mounting point. The unit optionally includes a modular storage case which is used for storage of accessories and personal items, which can be opened and hinged down or removed entirely from the unit in order to allow carrying or positioning in a different location.

50 Claims, 13 Drawing Sheets

Figure 1:
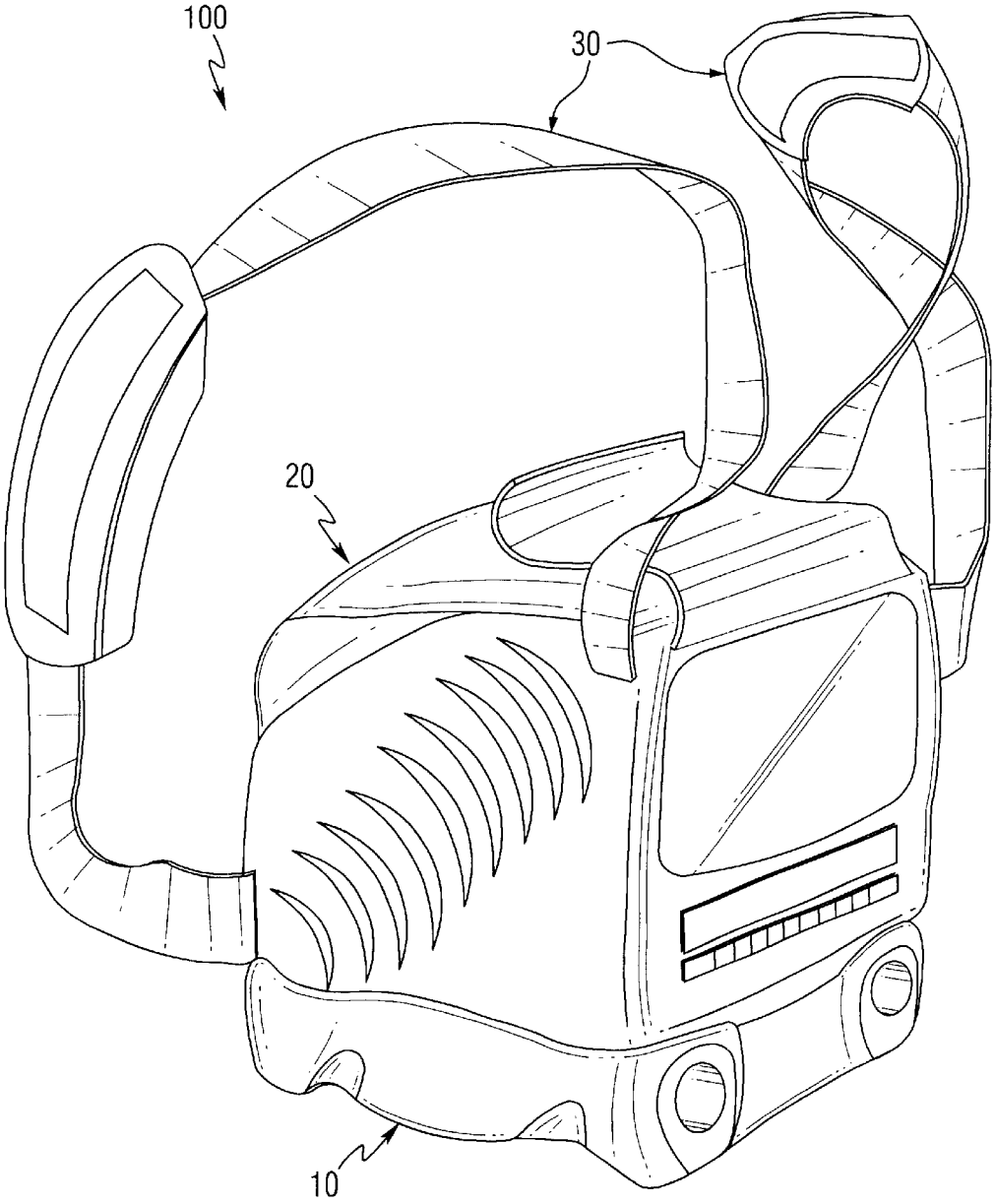

U.S. PATENT DOCUMENTS 4,673,070 A 6/1987 Ambal
4,756,528 A 7/1988 Umashankar
4,843,477 A 6/1989 Mizutani et al.
4,982,996 A 1/1991 Vottero-Fin et al.
5,010,988 A * 4/1991 Brown ..... 190/104
5,177,616 A 1/1993 Riday
5,217,119 A * 6/1993 Hollingsworth ..... 190/102
5,226,576 A 7/1993 Ellsworth
5,242,056 A * 9/1993 Zia et al. ..... 206/576
5,267,679 A 12/1993 Kamaya et al. ..... 224/151
5,329,947 A * 7/1994 Shikler ..... 132/291
5,330,049 A 7/1994 Bertelsen et al.
5,338,081 A 8/1994 Young et al.
5,437,367 A * 8/1995 Martin ..... 206/320
5,447,215 A * 9/1995 Volkmar et al. ..... 190/11
5,485,922 A 1/1996 Butcher ..... 206/576
5,515,974 A * 5/1996 Higson ..... 206/570
5,533,797 A 7/1996 Gelber ..... 312/138.1
5,555,466 A 9/1996 Scribner et al.
5,647,484 A * 7/1997 Fleming ..... 206/576
5,666,265 A * 9/1997 Lutz et al. ..... 361/683
5,676,223 A * 10/1997 Cunnimgham ..... 190/109
5,680,973 A * 10/1997 Vulpitta et al. ..... 224/153
5,706,992 A * 1/1998 Moor ..... 190/102
5,725,189 A 3/1998 Landy
5,779,036 A * 7/1998 Westbrook et al. ..... 190/102
5,868,294 A 2/1999 Webster
5,878,672 A * 3/1999 Ostermann et al. ..... 108/25
5,938,096 A 8/1999 Sauer et al. ..... 224/625
5,966,285 A 10/1999 Sellers ..... 361/686
6,026,961 A * 2/2000 McCarthy et al. ..... 206/576
6,047,752 A * 4/2000 Southwick ..... 150/112
D425,474 S * 5/2000 Bergh ..... D12/416
6,092,705 A 7/2000 Meritt
6,105,844 A * 8/2000 Walters et al. ..... 206/541
6,145,661 A * 11/2000 Jung ..... 206/320
6,296,165 B1 * 10/2001 Mears ..... 150/107
6,305,587 B1 * 10/2001 Miller ..... 224/153
D451,274 S * 12/2001 Kegels ..... D3/216

* cited by examiner

TELECOMMUNICATIONS EQUIPMENT TRANSPORTATION APPARATUS

FIELD OF THE INVENTION

The present invention relates to an apparatus for remotely transporting telecommunications equipment for portable use, and in particular to an apparatus for transportation of such equipment for use away from the home or office.

BACKGROUND OF THE INVENTION

Telecommunications transportation equipment existing in the state of the art suffers from several problems with regard to ease and portability of use as well as protection of the transported equipment. Deficiencies in equipment size, modularity, materials, water resistant integrity, internal and external structural support, remote power supply capability, user and equipment access, storage capacity, and design compatibility with the transportation medium and/or platform contribute to these problems, all of which are addressed and overcome by the present invention.

The present invention provides a unique carrying and fastening system designed for remotely transporting telecommunications equipment for portable use and in particular provides an apparatus for transportation of such devices, including but not limited to computer equipment, telephones, televisions (TVs) and television video cassette recorder (VCR) units, for use away from the home or office, both separately and in combination with each other and with other, peripheral and accessory equipment. The telecommunications equipment transportation apparatus of the present invention is designed to protect, organize, fasten and allow access to such equipment during transportation and use. The invention incorporates high quality construction into a well thought out design in terms of size, modularity, materials, water resistant integrity, internal and external structural support, remote power supply capability, user and equipment access, storage capacity, and design compatibility with the transportation medium and/or platform configuration to overcome the problems posed by the prior art. The invention enables people to safely bring along fragile telecommunications equipment for use in a variety of remote settings. The invention can be configured for use in vehicles such as but not limited to boats, minivans, sport utility vehicles, campers and cars, and in remote locations and buildings, as well as providing a convenient and professional means to transport such equipment for use in business presentation settings.

Accordingly, it is an object of the present invention to provide a unique carrying and fastening system designed for remotely transporting telecommunications equipment for portable use.

It is another object of the present invention to provide an apparatus for transportation of telecommunications equipment for use away from the home or office.

It is another object of the present invention to provide an apparatus for transporting devices such as but not limited to computer equipment, telephones, televisions and television video cassette recorder units, for use both separately and in combination with each other and with other peripheral and accessory equipment.

It is another object of the present invention to provide a telecommunications equipment transportation apparatus designed to protect, organize, fasten and allow access to such equipment during transportation and use.

It is another object of the present invention to provide a telecommunications equipment transportation apparatus for that incorporates a unique and improved construction and design in terms of size, modularity, materials, water resistant integrity, internal and external structural support, remote power supply capability, user and equipment access, storage capacity, and design compatibility with the transportation medium and/or platform configuration to overcome the problems posed by the prior art.

It is another object of the present invention to provide a telecommunications equipment transportation apparatus that enables people to safely bring along fragile telecommunications equipment for use in a variety of remote settings.

It is another object of the present invention to provide a telecommunications equipment transportation apparatus that can be configured for use in vehicles such as but not limited to boats, minivans, sport utility vehicles, campers and cars, and in remote locations and buildings as well as providing a convenient and professional means to transport such equipment for use in business presentation settings.

SUMMARY OF THE INVENTION

The present invention relates to an apparatus for remotely transporting telecommunications equipment for portable use, and in particular to an apparatus for transportation of such equipment for use away from the home or office. The telecommunications equipment transportation apparatus of the present invention is comprised of components including a base section, a container section and a harness system. The base provides a suspension which forms the supporting foundation for the unit and the equipment stored therein, and houses a power circuit that includes electrical outlet(s) for providing battery or generator-supplied alternating current (AC) or direct current (DC) power to the transported telecommunications equipment.

The container can be comprised of compartments that can be totally sealed for transport and storage, along with panel(s) which open to allow access to the viewing monitor and/or controls of transported equipment such as computers and TV sets. The container preferably provides a mounting point for the base and incorporates flexible ventilated structural panels along one or more or all surfaces, and also includes an internal strapping arrangement to provide an adjustable locking mechanism to secure and contain the transported equipment.

The harness system is designed for multiple application use to accommodate placement of the transported equipment in different locations and configurations, and includes fasteners and straps designed to secure the system both from the interior and exterior, with multiple attachment points to allow for adjustment of either the external harness system and/or internal harness system to accommodate differently sized and/or constructed anchoring points for the unit. An optional carrying strap is designed so the system can be transported as a hand held unit, and the fasteners and straps can be arranged so that the unit can be hung from any mounting point.

The unit optionally includes a modular storage case which is used for storage of accessories and personal items, and which can be opened and hinged down or removed entirely from the unit in order to allow carrying or positioning in a different location.

The subject matter which is regarded as the invention is particularly pointed out and distinctly claimed in the concluding portion of the specification. The invention, however, together with further objects and advantages thereof, may best be understood by reference to the following description taken in conjunction with the accompanying drawings

BRIEF DESCRIPTION OF THE DETAILED DRAWINGS

FIG. 1 provides a perspective of the telecommunications equipment transportation apparatus oft invention.

Figure 2:
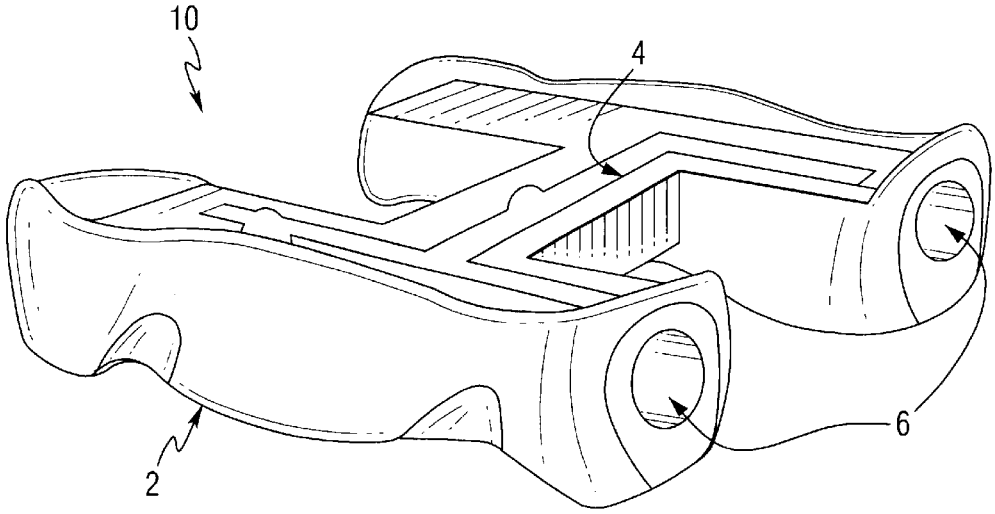

FIG. 2 provides a perspective view of the base section of the telecommunications equipment transportation apparatus of the present invention.

Figure 3A:
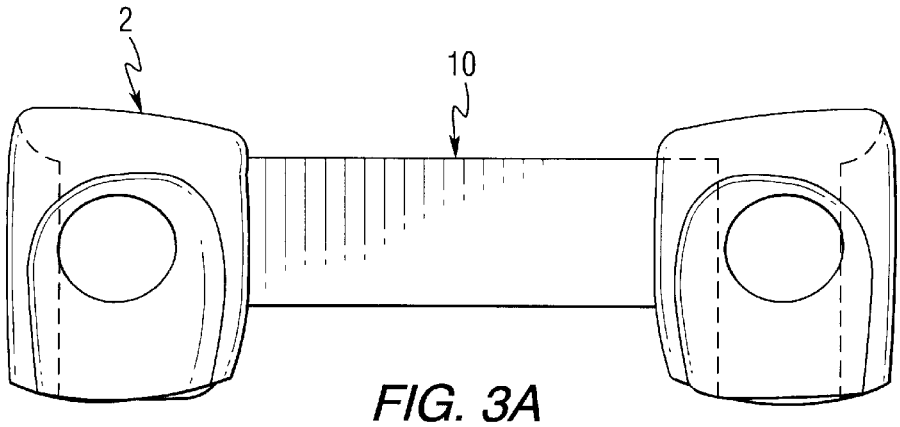
Figure 3B:
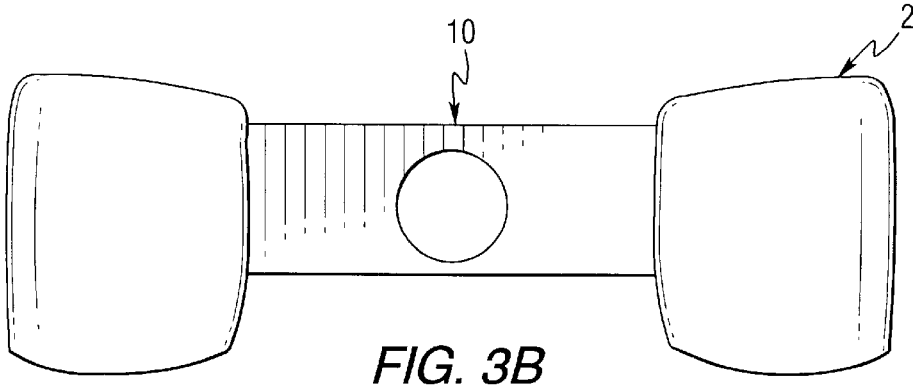

FIGS. 3A and 3B provide elevation views of the base section of the telecommunications equipment transportation apparatus of the present invention.

Figure 4:
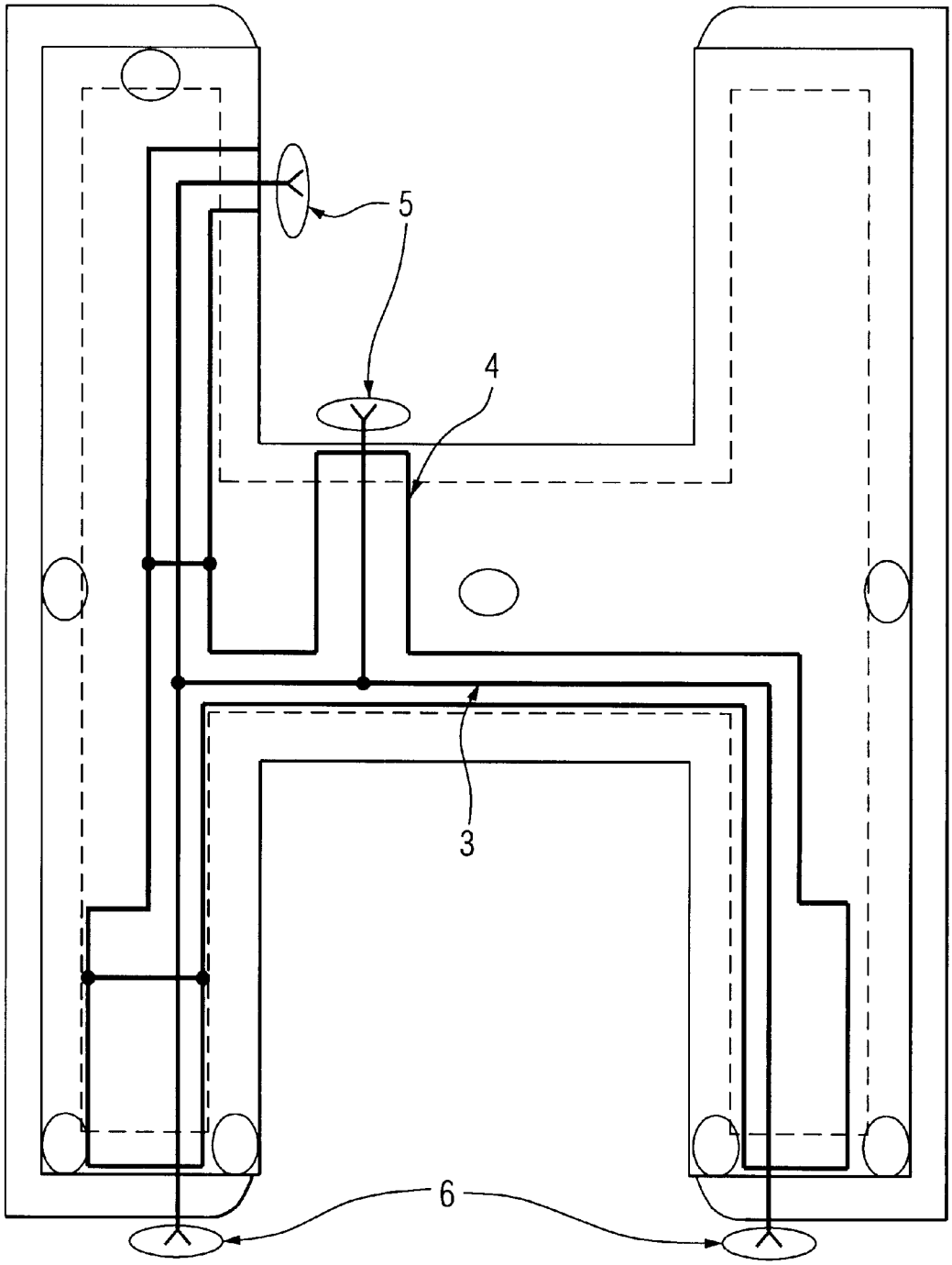

FIG. 4 provides an overhead view of the base section displaying the electrical circuitry of the elecommunications equipment transportation apparatus of the present invention.

Figure 5:
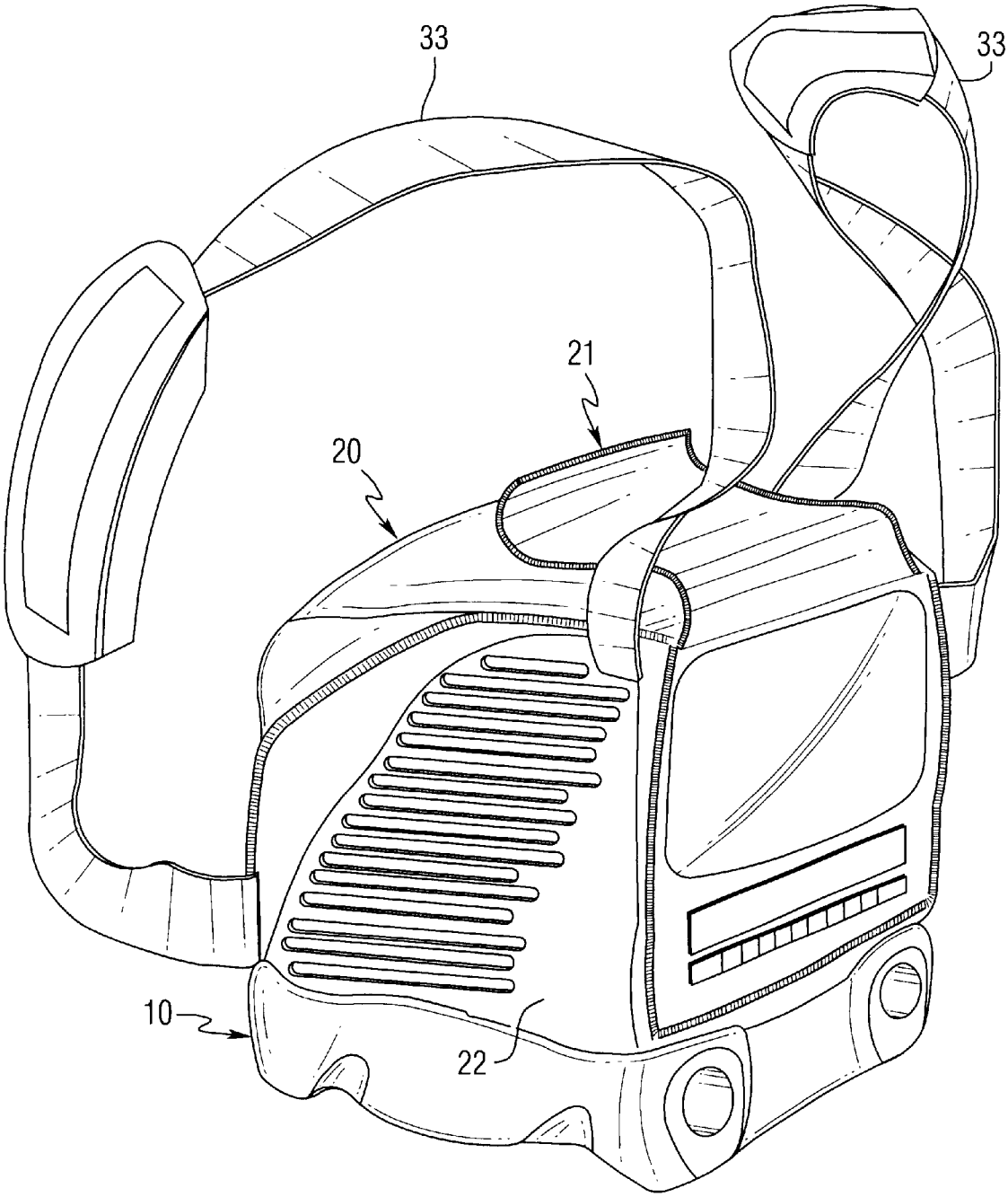
Figure 6:
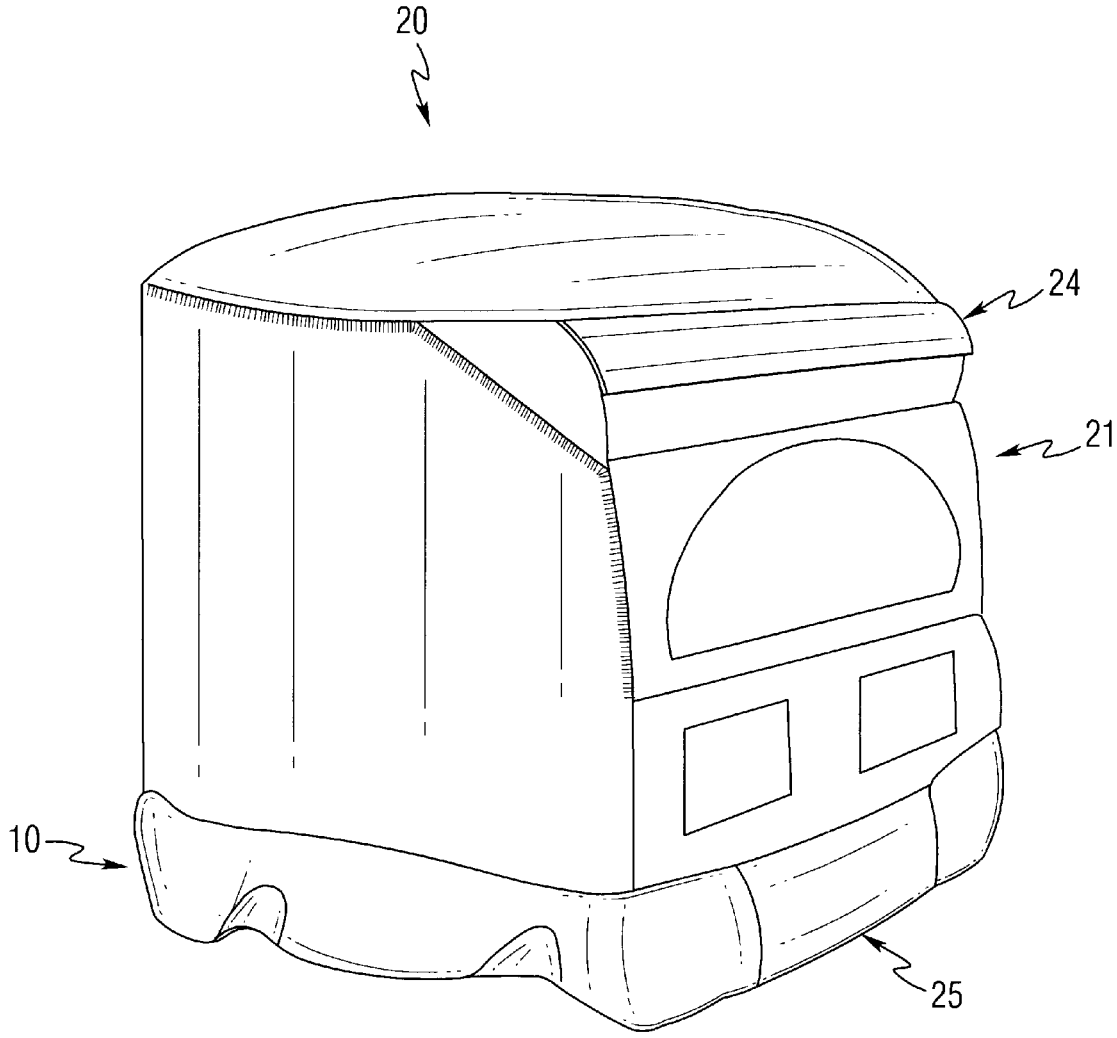

FIGS. 5 and 6 provide perspective view of the container section of the telecommunications equipment transportation apparatus of the present invention.

FIGS. 7 through 10 provide perspective view of the harness system of the telecommncations equipment transportation apparatus of the present invention.

FIGS. 11A through 11D provide various perspective views of the modular storage compartment used in connection with the telecommunications equipment transportation apparatus of the present invention.

DETAILED DESCRIPTION OF THE PREFERRED EMBODIMENT

The telecommunications equipment transportation apparatus 100 of the present invention, shown generally in FIG. 1, consists of the following major components: base section 10; container section 20; and harness system 30, plus an optional modular storage compartment 40 (not shown in FIG. 1).

As shown in FIGS. 2 and 3, base 10 is preferably made of a lightweight molded water resistant construction which protects the system from the elements and also provides a sturdy suspension which forms the supporting foundation for the unit 100 and the equipment stored therein. The molded base 10 is preferably constructed of plastic or rubber based materials to provide a friction fit for securing the stored equipment when acting in cooperation with the harness system 30. FIGS. 2 and 3 show a preferred configuration of base 10; including legs 2 that are capable of being configured with extensions that accommodate varying viewing angles for the equipment when in use. Base 10 can optionally be configured with molded rubber mounts placed at various locations (not shown) along its structure to enhance the friction fit of the device when in use.

As shown in FIG. 4, base 10 houses a power circuit 3 within a channel 4 molded into the base 10. Power circuit 3 includes electrical outlet(s) 5 and 6 for providing battery or generator-supplied alternating current (AC) or direct current (DC) power to the transported telecommunications equipment, which can include but is not limited to computer equipment, telephones, televisions (TVs) and television video cassette recorder (VCR) units, used both separately and in combination with each other and with other peripheral and accessory equipment. Outlets 5 and 6 can also accommodate the use of peripheral electronic equipment such as CD players, printers, fax machines, video and audio cassette equipment, video games, AC/DC converters, modems, radios, etc. Power circuit 3 exits the base at outlets 5 and 6 and is configured to provide sufficient power cord length to accommodate the supply of external DC or AC power to the unit 100.

Figure 7:
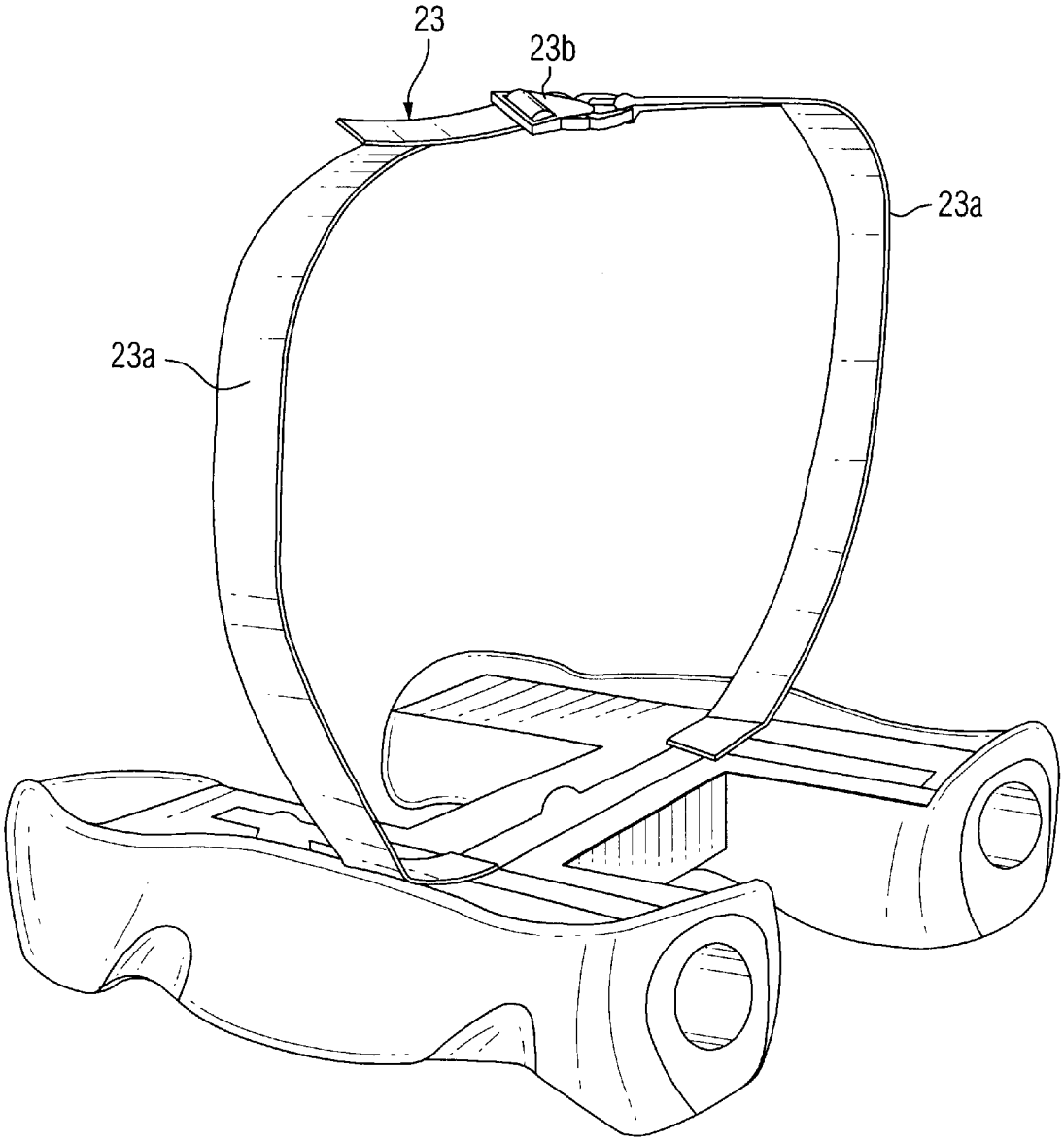

Container 20 is shown in FIGS. 5 and 6 and is preferably constructed of light weight, durable materials similar to those used in the manufacture of luggage, duffel bags and backpacks. The exterior and/or interior contact surfaces of container 20 preferably incorporate a padded or otherwise reinforced construction to protect vulnerable electronic equipment from handling wear and tear. The compartments of container section 20 can be totally reversibly, sealed for transport and storage, but can optionally include panel(s) 21 which open to allow access to the viewing monitor and/or controls of the transported equipment such as computers and TV sets. Container section 20 incorporates flexible ventilated structural panels 22 along one or more or all surfaces to maintain the shape of the container 20 and provide a mounting point for the base 10 and harness system 30. As shown in FIG. 7, container 20 uses an internal strapping arrangement 23 that preferably uses rubber coated straps 23*a* and an adjustable but solid locking mechanism 23*b* to secure and contain the transported equipment. Container 20 also optionally includes zippered or Velcro or other similarly fastenable openings 24 located where required on any portion of the device to accommodate various interface components such as antennas, remote control devices, headsets, cables, mouses, modem and other connection jacks, adapters, etc., and can include independent storage compartments 25 to contain the AC and DC power connection equipment.

Figure 8:
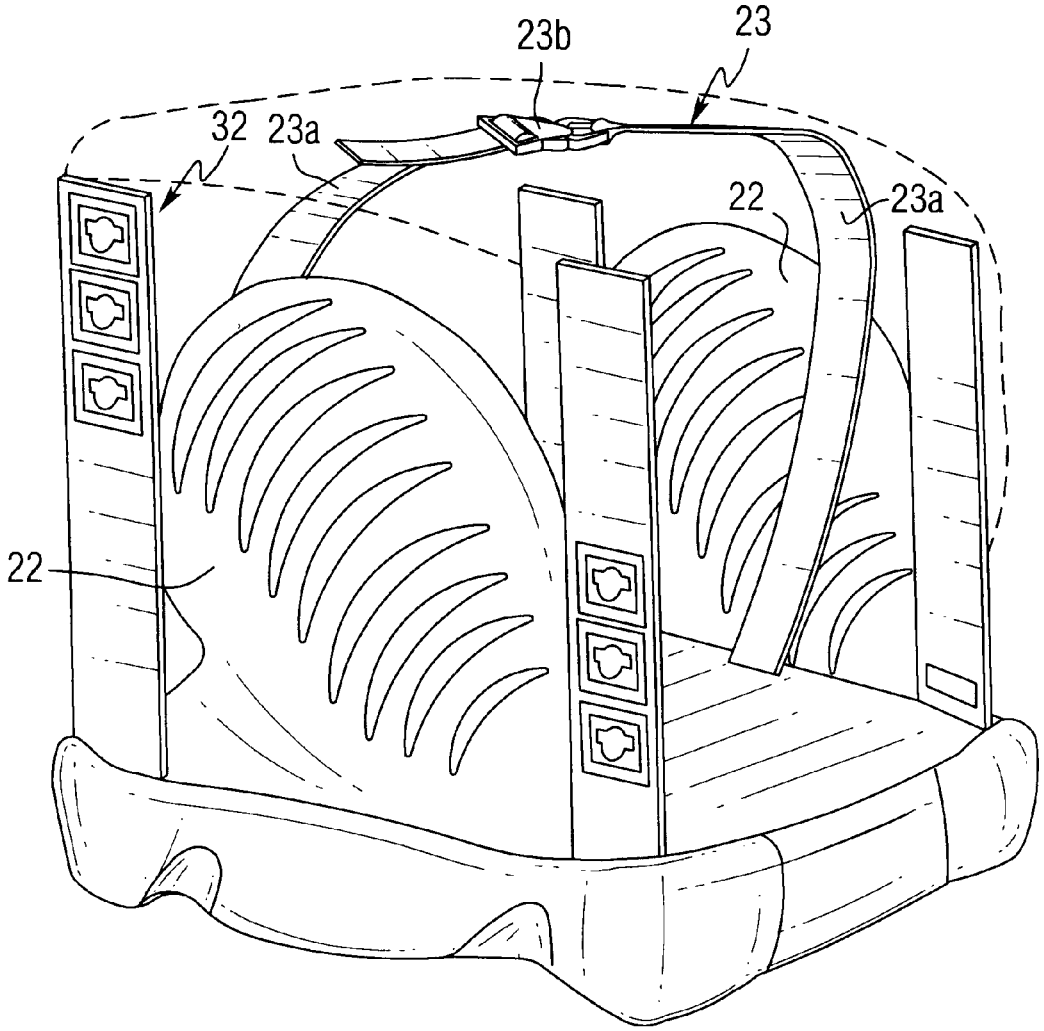
Figure 9:
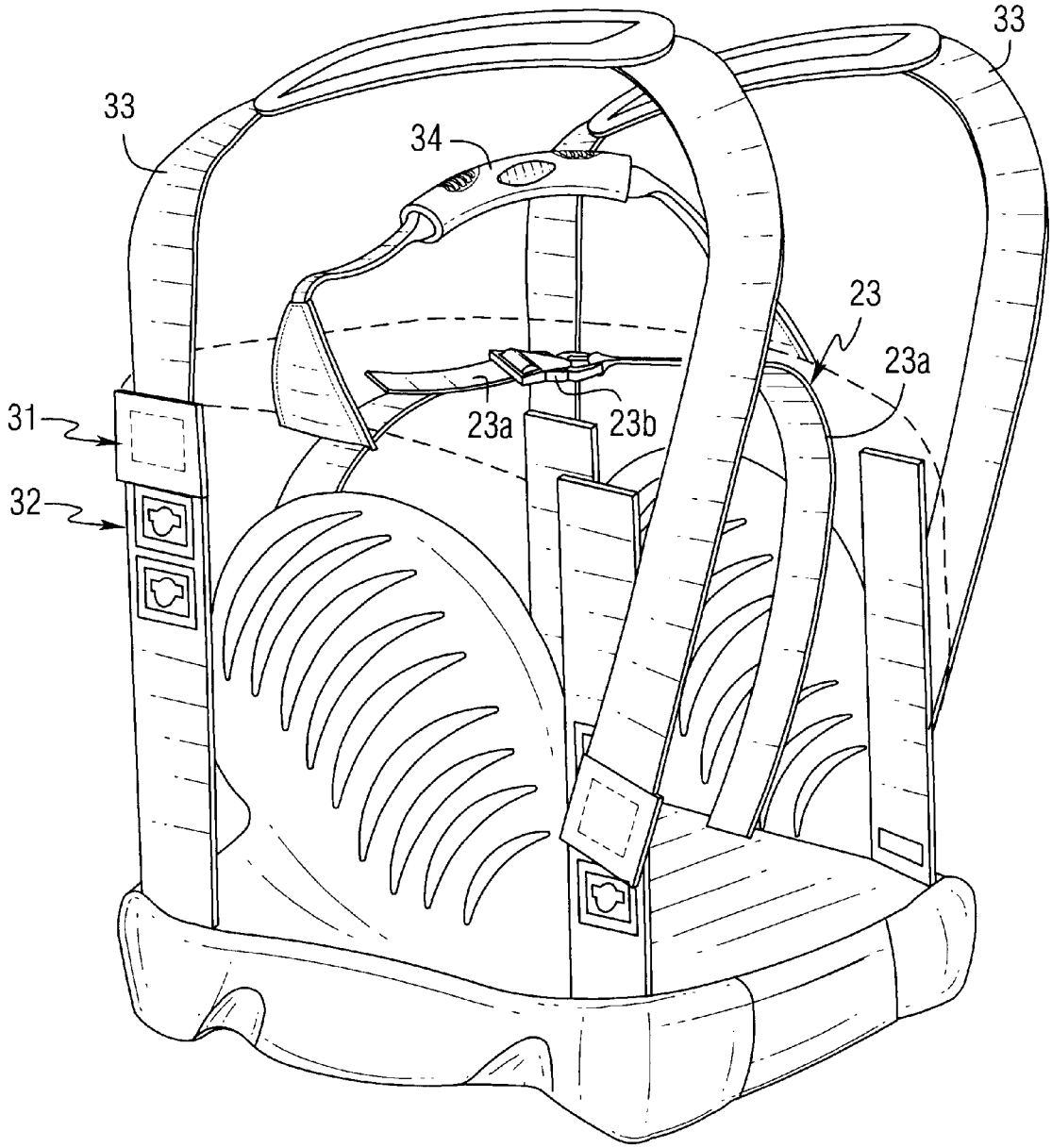
Figure 10:
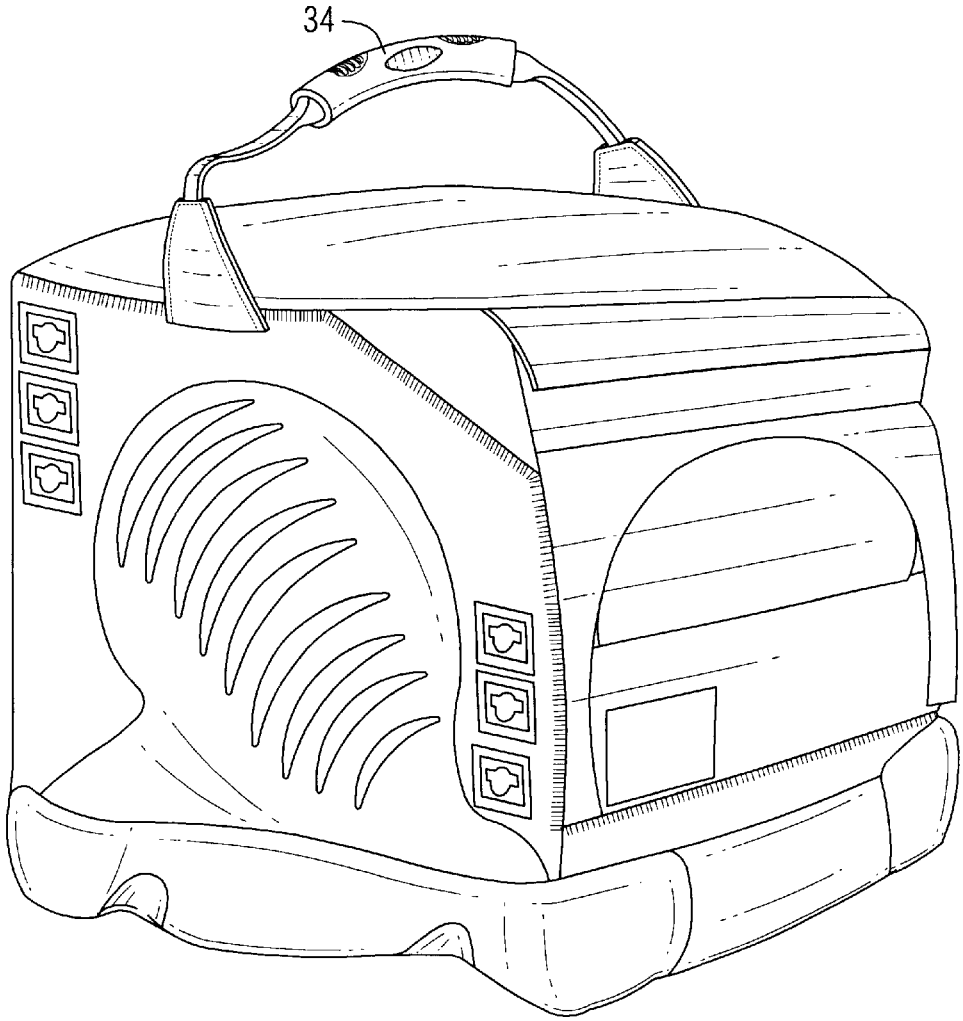

As shown in FIGS. 7–10, a unique aspect of the present invention is its multi-application harness system 30 which accommodates safe and convenient placement and securement of the transported equipment in a variety of locations and configurations. Preferably, fasteners 31 and 32 and straps 33 are designed to provide maximum flexibility for secure arrangement of the system in most vehicles, including boats, vans, sport utility vehicles (SUVs) and cars, using existing attachment points such as seats and head rests. As shown in FIGS. 8 and 9, fasteners 31 and 32 provide multiple attachment points to allow for adjustment of either external harness system 30 and/or internal harness system 23 to accommodate differently sized and constructed seats positioned in different planes. As shown in FIG. 10, an optional carrying strap 34 is designed so the system 100 can be easily transported as a hand held unit. Likewise, fasteners 31 and 32 and straps 33 can be arranged so that the unit 100 can be simply hung from a mounting point on a vertical surface.

Figure 11A:
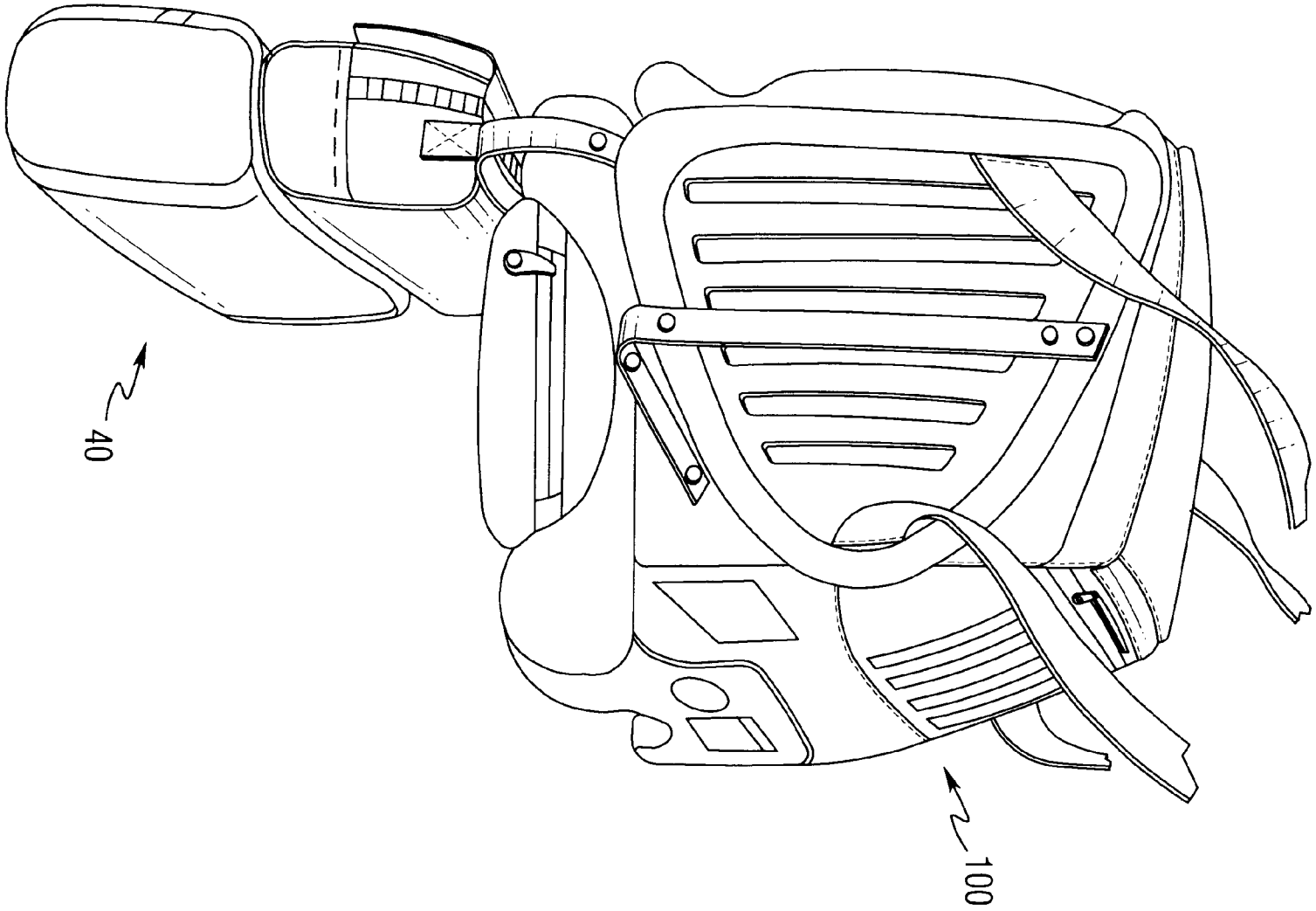
Figure 11B:
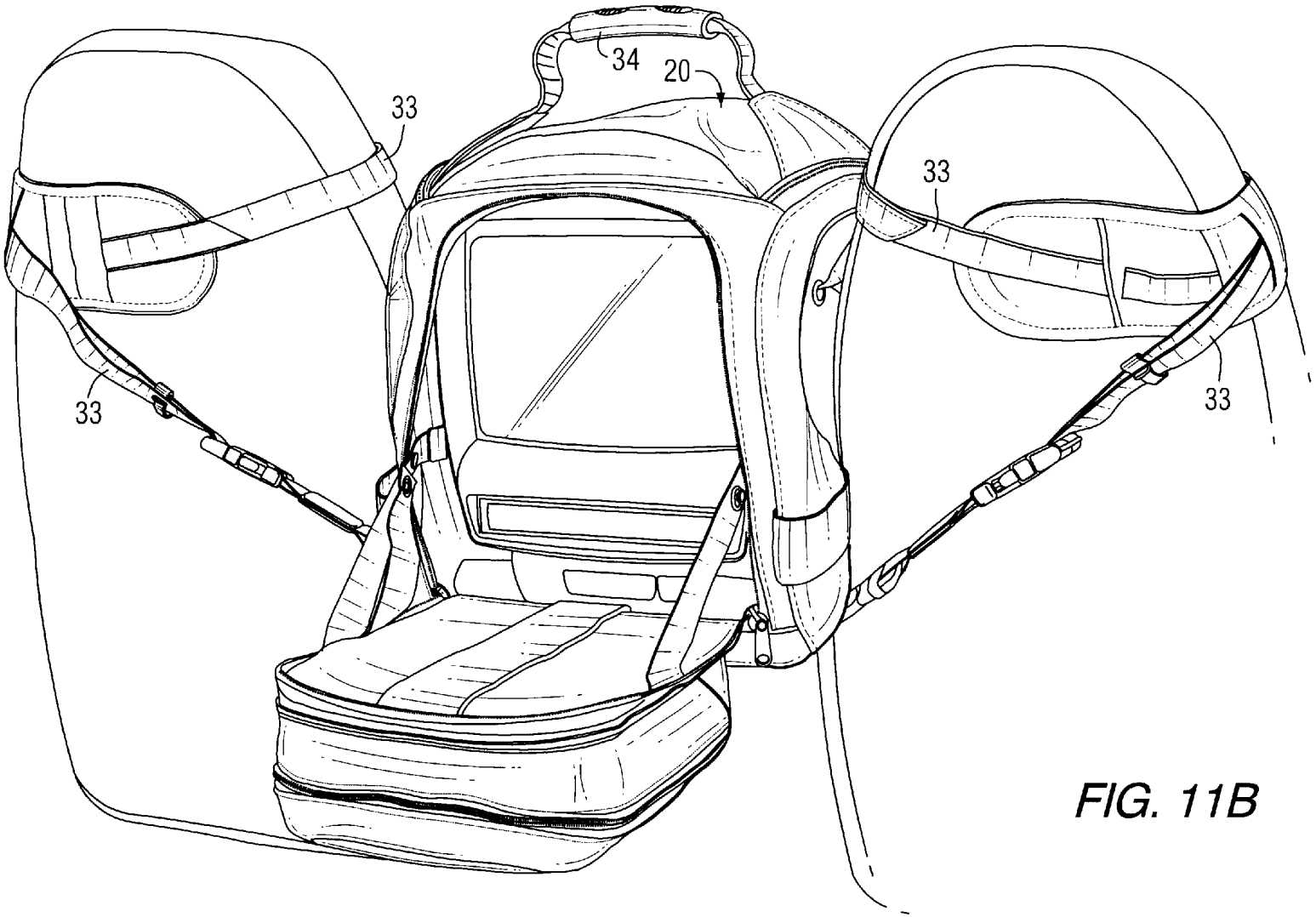
Figure 11C:
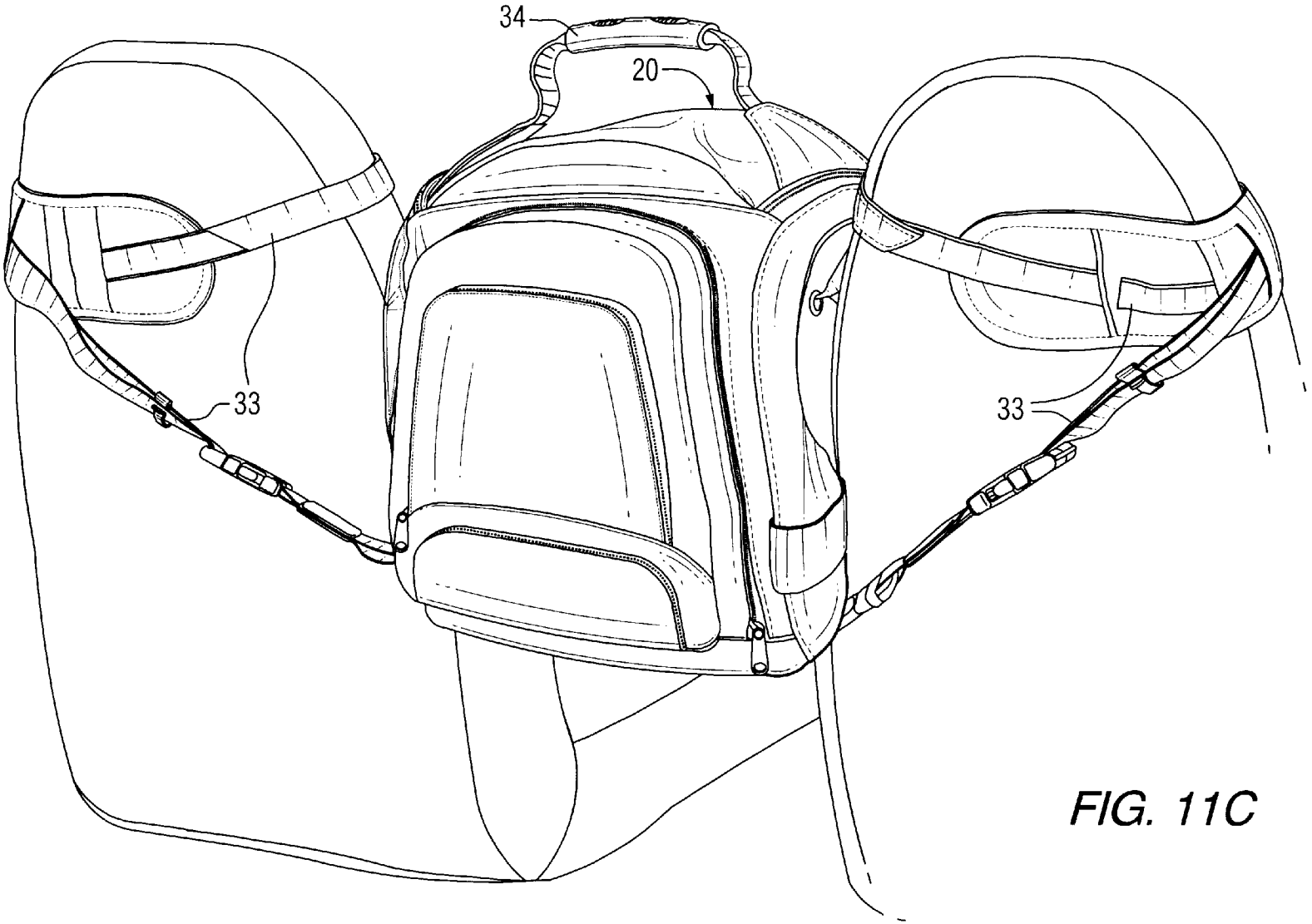
Figure 11D:
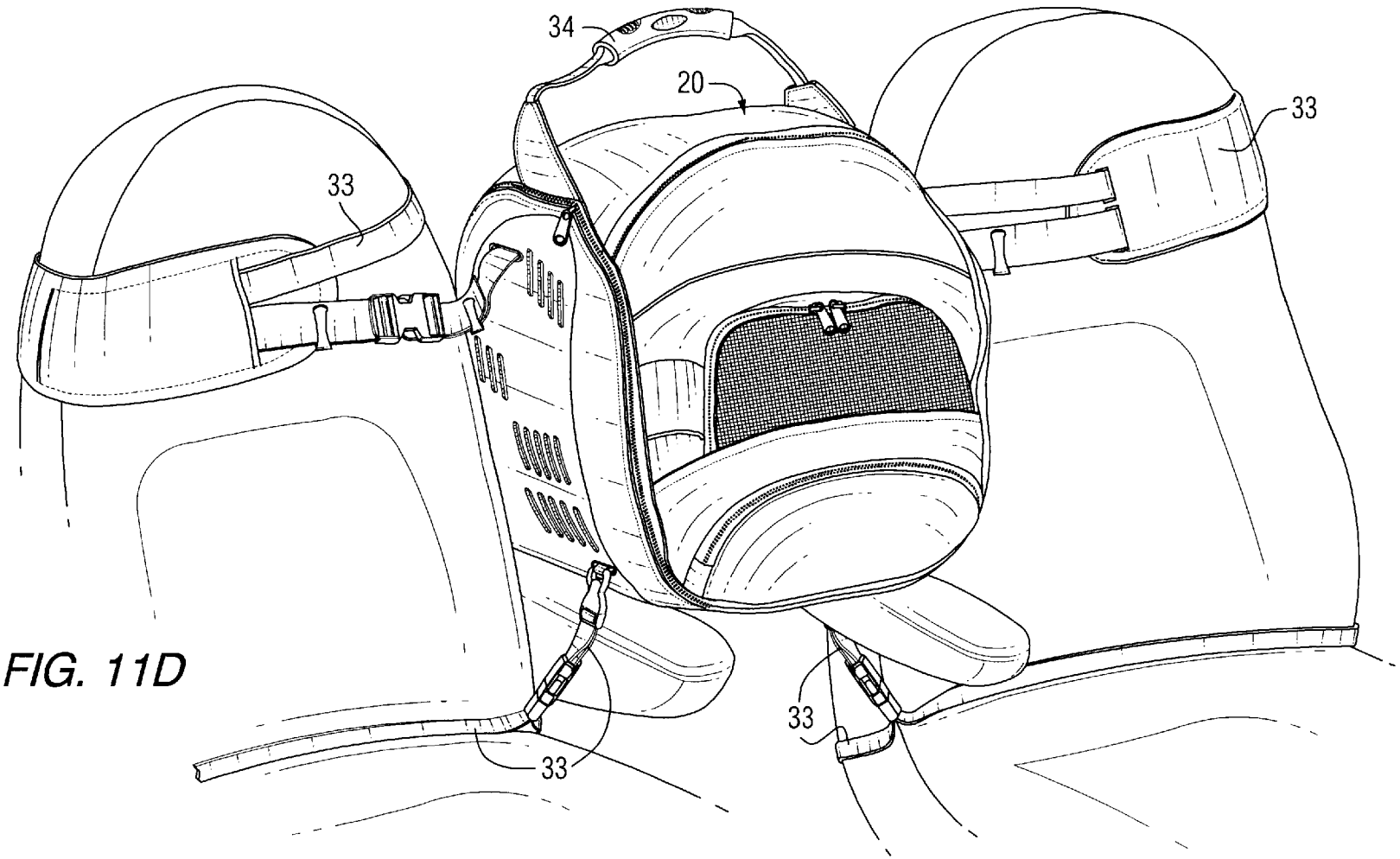

As shown in FIG. 11A, the telecommunications equipment transportation unit 100 can optionally include a modular storage case 40 which is perfect for organizing and protecting accessories such as compact disks, tapes, games, audio and videocassettes, etc., and for providing a convenient place to carry personal items. As shown in FIG. 11*a*, modular storage case 40 can be opened and hinged down or removed entirely from the unit 100 in order to allow carrying or positioning in a different location. FIG. 11D shows a rear view and FIGS. 11B and 11C show a front view of the unit 100 as installed between the seats of a vehicle.

While only certain preferred features of the invention have been shown by way of illustration, many modifications and changes can be made. It is to be understood that the appended claims are intended to cover all such modifications and changes as fall within the true spirit and scope of the invention, as embodied in the following claims.

What is claimed is:

1. Apparatus for securing telecommunications equipment to a transportation vehicle that includes seats, said apparatus comprising:

(a) a container section for housing the telecommunications equipment during transportation thereof, said container having a plurality of flexible panels that open to provide access to said equipment during use;

(b) an external harness that is connected to said container section and that secures said container section laterally between the seats of the transportation vehicle such that all of said flexible panels of said container are accessible at times when said container is secured to said transportation vehicle; and (c) an internal harness that is connected to the container section, said internal harness having a mechanism for adjusting the internal harness to secure said telecommunications equipment during use in said container at times when said external harness secures said container section to the seats of the transportation vehicle and when at least one of said flexible panels of said container is open to provide access to said equipment during use.

2. The apparatus of claim 1 wherein said external harness includes a plurality of straps, each of said straps securing said container section to a respective one of the seats of said transportation vehicle.

3. The apparatus of claim 1 wherein said container incorporates a padded construction to protect equipment contained therein.

4. The apparatus of claim 1 wherein said container section includes at least one structural panel having vents therein.

5. The apparatus of claim 1 wherein said container section includes at least one structural panel that provides a mounting point for said external harness system.

6. The apparatus of claim 2 wherein the seats of the transportation vehicle include head rests and wherein said external harness secures said container to the headrests of the seats.

7. The apparatus of claim 2 wherein said external harness is adjustable such that it selectively accommodates seats having various construction.

8. The apparatus of claim 2 wherein said external harness is adjustable such that it selectively accommodates seats having various sizes.

9. The apparatus of claim 2 wherein said vehicle includes at least two seats that are spaced apart and said container is located between the seats of said vehicle.

10. Apparatus for securing telecommunications equipment to a transportation vehicle that includes seats, said apparatus comprising:

(a) a container section for housing the telecommunications equipment during transportation thereof, said container having a plurality of flexible panels that open to provide access to said equipment during use;

(b) an external harness that is connected to said container section and that secures said container section laterally between the seats of the transportation vehicle such that all of said panels are accessible for use at times when said container section is secured to said transportation vehicle; and (c) an internal harness that is connected to the container section, said internal harness having a mechanism for adjusting the internal harness, said mechanism being used to adjust said internal harness to secure said telecommunications equipment during use in said container at times when at least one of said flexible panels of said container is open to provide access to said equipment for use, and when said external harness secures said container to the transportation vehicle, said mechanism also being used to adjust said internal harness to secure various sizes of said telecommunications equipment.

11. The apparatus of claim 10 wherein said external harness includes a plurality of straps, each of said straps securing said container section to a respective one of the seats of said transportation vehicle.

12. The apparatus of claim 10 wherein said container section includes at least one structural panel having vents therein.

13. The apparatus of claim 10 wherein said container section includes at least one structural panel that provides a mounting point for said external harness system.

14. The apparatus of claim 10 wherein said container further includes a second panel that is opened to provide access to the telecommunications equipment and wherein, said adjustment mechanism of said internal harness is used to secure said telecommunications equipment in said container at times when said second panel of said container is open to provide access to said equipment for use.

15. The apparatus of claim 11 wherein the seats of the transportation vehicle include head rests and wherein said external harness secures said container to the headrests of the seats.

16. The apparatus of claim 11 wherein said external harness is adjustable such that it selectively accommodates seats having various construction.

17. The apparatus of claim 11 wherein said external harness is adjustable such that it selectively accommodates seats having various sizes.

18. The apparatus of claim 11 wherein said vehicle includes at least two seats that are spaced apart and said container is located between the seats of said vehicle.

19. Apparatus for securing telecommunications equipment to a transportation vehicle that includes seats, said apparatus comprising:

(a) a container section for housing the telecommunications equipment during transportation thereof, said container having affront side and a rear side, said container section also having a first panel on the front of said container that opens to provide access to said equipment during use of the telecommunications equipment, said container also having a second panel on the rear of said container that also opens to provide access to said equipment for use;

(b) an external harness that is connected to said container section and that secures said container section laterally between the seats of the transportation vehicle with said first panel and said second panel being opened to provide access to the equipment at times when said container is secured to the transportation vehicle; and (c) an internal harness that is connected to the container section, said internal harness having a mechanism for adjusting the internal harness, said mechanism being used to adjust said internal harness to secure said telecommunications equipment during use in said container at times when said external harness secure said container section to the transportation vehicle and when said second panel of said container is open to provide access to said equipment for use, said mechanism also being used to adjust said internal harness to secure various sizes of said telecommunications equipment.

20. The apparatus of claim 19 wherein sad external harness includes a plurality of straps, each of said straps securing said container section to a respective one of the seats of said transportation vehicle.

21. The apparatus of claim 19 wherein said container incorporates a padded construction to protect equipment contained therein.

22. The apparatus of claim 19 wherein said container section includes at least one structural panel having vents therein.

23. The apparatus of claim 19 wherein said container section includes at least one structural panel that provides a mounting point for said external harness system.

24. The apparatus of claim 20 wherein said vehicle includes at least two seats that are spaced apart and said container is located between the seats of said vehicle.

25. The apparatus of claim 20 wherein the seats of the transportation vehicle include headrests and wherein said external harness secures said container to the headrests of the seats.

26. The apparatus of claim 20 wherein said external harness is adjustable such that it selectively accommodates seats having various construction.

27. The apparatus of claim 20 wherein said external harness is adjustable such that it selectively accommodates seats having various sizes.

28. Apparatus for securing telecommunications equipment to a transportation vehicle that includes seats, said apparatus comprising:

(a) a container section for housing the telecommunications equipment during transportation thereof, said container having a plurality of flexible panels that open to provide access to said equipment for use, said container also having structural panels;

(b) an external harness that is mounted to at least one structural panel of said container section, said external harness being connected to said container section, said external harness attaching said container section laterally between the seats of the transportation vehicle such that all of said flexible panels of said container are accessible at times when said container is secured to said transportation vehicle; and (c) an internal harness that is mounted to at least one structural panel of said container section, said internal harness having a mechanism for adjusting the internal harness to secure said telecommunications equipment during use in said container at times when said external harness secures said container section to the seats of the transportation vehicle and when at least one of said flexible panels of said container is open to provide access to said equipment for use.

29. The apparatus of claim 28 wherein said external harness and said internal harness are mounted to the same structural panel.

30. The apparatus of claim 29 wherein said external harness includes a plurality of straps, each of said straps securing said container section to a respective one of the seats of said transportation vehicle.

31. The apparatus of claim 29 wherein said container incorporates a padded construction to protect equipment contained therein.

32. The apparatus of claim 29 wherein at least one of said structural panels includes vents therein.

33. The apparatus of claim 29 wherein said external harness is adjustable such that it selectively accommodates seats having various construction.

34. The apparatus of claim 29 wherein said external harness is adjustable such that it selectively accommodates seats having various sizes.

35. The apparatus of claim 29 wherein said vehicle includes at least two seats that are spaced apart and said container is located between the seats of said vehicle.

36. Apparatus for securing telecommunications equipment to a transportation vehicle that includes seats, said apparatus comprising:

(a) a container section for housing the telecommunications equipment during transportation thereof, said container having a plurality of flexible panels that open to provide access to said equipment for use, said container also have structural panels;

(b) an external harness that is mounted to said structural panels, said external harness being connected to said container section, said external harness attaching said container section laterally between the seats of the transportation vehicle such that all of said flexible panels can be opened for use at times when said container section is secured to said transportation vehicle; and (c) an internal harness that is mounted to said structural panels, said internal harness having a mechanism for adjusting the internal harness, said mechanism being used to adjust said internal harness to secure said telecommunications equipment in said container at times when at least one of said flexible panels of said container is open to provide access to said equipment during use, and when said external harness secures said container to the transportation vehicle, said mechanism also being used to adjust said internal harness to secure various sizes of said telecommunications equipment.

37. The apparatus of claim 36 wherein said external harness and said internal harness are mounted to the same structural panel.

38. The apparatus of claim 37 wherein said external harness includes a plurality of straps, each of said straps securing said container section to a respective one of the seats of said transportation vehicle.

39. The apparatus of claim 37 wherein said external harness is adjustable such that it selectively accommodates seats having various construction.

40. The apparatus of claim 37 wherein said external harness is adjustable such that it selectively accommodates seats having various sizes.

41. The apparatus of claim 37 wherein said vehicle includes at least two seats that are spaced apart and said container is located between the seats of said vehicle.

42. The apparatus of claim 37 wherein said container further includes a second flexible panel that is opened to provide access to the telecommunications equipment and wherein, said adjustment mechanism of said internal harness is used to secure said telecommunications equipment in said container at times when said second flexible panel of said container is open to provide access to said equipment for use.

43. Apparatus for securing telecommunications equipment to a transportation vehicle that includes seats, said apparatus comprising:

(a) a container section for housing the telecommunications equipment during transportation thereof, said container having a front flexible panel that is located in the front of said container and that is opened to provide access to said equipment for use, said container also having at least one ventilated flexible panel to ventilate said container at times when said front flexible panel is open and also at times when said front flexible panel is closed;

(b) an external harness that is connected to said container section and that secures said container section laterally between the seats of the transportation vehicle with said front flexible panel being opened for use at times when said container section is secured to said transportation vehicle; and (c) an internal harness that is connected to the container section, said internal harness having a mechanism for adjusting the internal harness, said mechanism being used to adjust said internal harness to secure said telecommunications equipment in said container at times when said front flexible panel of said container is open to provide access to said equipment during use of the telecommunications equipment, and when said external harness secures said container to the transportation vehicle, said mechanism also being used to adjust said internal harness to secure various sizes of said telecommunications equipment.

44. The apparatus of claim 43 wherein at least one of said ventilated flexible panels is located on the back of said container.

45. The apparatus of claim 43 wherein at least one of said ventilated flexible panels is located on the side of said container.

46. The apparatus of claim 43 wherein said external harness includes a plurality of straps, each of said straps securing said container section to a respective one of the seats of said transportation vehicle.

47. The apparatus of claim 44 wherein at least one of said ventilated flexible panels is also located on the side of said container.

48. The apparatus of claim 46 wherein said external harness is adjustable such that it selectively accommodates seats having various construction.

49. The apparatus of claim 46 wherein said external harness is adjustable such that it selectively accommodates seats having various sizes.

50. The apparatus of claim 46 wherein said vehicle includes at least two seats that are spaced apart and said container is located between the seats of said vehicle.

* * * * *

UNITED STATES PATENT AND TRADEMARK OFFICE

CERTIFICATE OF CORRECTION

PATENT NO. : 6,473,315 B2
DATED : October 29, 2002
INVENTOR(S) : Denmeade

It is certified that error appears in the above-identified patent and that said Letters Patent is hereby corrected as shown below:

Title page,
Item [56], add the following:

-- OTHER PUBLICATIONS

Brookstone Company, Catalog pg. 57 entitled "E. Make those Long Family Trips Easier-Take Entertainment on the Road" Catalog Number T235267 (TV/VCP) Price for set $699.96 --

Signed and Sealed this

Twenty-eighth Day of October, 2003

JAMES E. ROGAN
*Director of the United States Patent and Trademark Office*